US007384596B2

(12) United States Patent
Woodfield et al.

(10) Patent No.: US 7,384,596 B2
(45) Date of Patent: Jun. 10, 2008

(54) METHOD FOR PRODUCING A METALLIC ARTICLE HAVING A GRADED COMPOSITION, WITHOUT MELTING

(75) Inventors: Andrew Philip Woodfield, Cincinnati, OH (US); Clifford Earl Shamblen, Cincinnati, OH (US); Eric Allen Ott, Cincinnati, OH (US); Michael Francis Xavier Gigliotti, Glenville, NY (US)

(73) Assignee: General Electric Company, Schenectady, NY (US)

( * ) Notice: Subject to any disclaimer, the term of this patent is extended or adjusted under 35 U.S.C. 154(b) by 371 days.

(21) Appl. No.: 10/896,702

(22) Filed: Jul. 22, 2004

(65) Prior Publication Data

US 2006/0018781 A1 Jan. 26, 2006

(51) Int. Cl.
*B22F 3/02* (2006.01)

(52) U.S. Cl. ..... 419/66; 419/30; 419/34; 419/38; 75/330; 75/351

(58) Field of Classification Search ..... 419/31, 419/660; 359/333; 75/234
See application file for complete search history.

(56) References Cited

U.S. PATENT DOCUMENTS

| | | | | |
|---|---|---|---|---|
| 3,152,389 | A | 10/1964 | Alexander et al. | |
| 3,992,161 | A * | 11/1976 | Cairns et al. | 75/234 |
| 4,659,288 | A | 4/1987 | Clark et al. | |
| 5,100,050 | A | 3/1992 | Krueger et al. | |
| 5,312,650 | A | 5/1994 | Dalal et al. | |
| 6,322,720 | B1 | 11/2001 | Reutova et al. | |
| 6,737,017 | B2 | 5/2004 | Woodfield et al. | |
| 2002/0025272 | A1 * | 2/2002 | Witherspoon et al. | 419/66 |
| 2002/0136658 | A1 | 9/2002 | Dilmore et al. | |
| 2003/0117691 | A1 * | 6/2003 | Bi et al. | 359/333 |

FOREIGN PATENT DOCUMENTS

| | | | | |
|---|---|---|---|---|
| DE | 0282946 | A | 9/1988 | |
| GB | 1433555 | A | 6/2004 | |
| GB | 1437421 | A | 7/2004 | |
| GB | 1440752 | A | 7/2004 | |
| JP | 57-164958 | * | 10/1982 | 419/31 |
| WO | WO0145906 | A | 6/2001 | |
| WO | WO03106080 | A | 12/2003 | |

* cited by examiner

*Primary Examiner*—Roy King
*Assistant Examiner*—Weiping Zhu
(74) *Attorney, Agent, or Firm*—McNees Wallace & Nurick LLC

(57) ABSTRACT

A method for preparing a metallic article made of metallic constituent elements includes furnishing a mixture of nonmetallic precursor compounds of the metallic constituent elements. The method further includes chemically reducing the mixture of nonmetallic precursor compounds to produce an initial metallic material, without melting the initial metallic material, and consolidating the initial metallic material to produce a consolidated metallic article, without melting the initial metallic material and without melting the consolidated metallic article. A net macroscopic composition of the consolidated metallic article varies spatially according to a pre-selected pattern

29 Claims, 2 Drawing Sheets

METHOD FOR PRODUCING A METALLIC ARTICLE HAVING A GRADED COMPOSITION, WITHOUT MELTING

This invention relates to the production of metallic articles without melting, and more particularly to such articles that have an intentionally spatially varied net macroscopic composition.

BACKGROUND OF THE INVENTION

In many applications, the requirements for the optimal performance of a metallic article vary with the location in the article. As an example, an aircraft gas turbine engine disk supports blades that are contacted by a gas stream. The disk and the supported blades are rotated at high rates by a shaft that is joined to the disk near its center. In such a gas turbine engine disk, high tensile strength and fatigue strength at moderate temperatures are required near the hub or center of the disk, and high creep strength, crack-growth resistance, corrosion/oxidation resistance, and surface-damage tolerance at higher temperatures are required near the rim of the disk. Additionally, these properties must be achieved while minimizing the weight of the disk.

Originally, the disks were made of a single material, such as a titanium-base alloy or a nickel-base alloy, with a single heat treatment. However, the different properties required in the different locations of the disk are typically not achievable with a single material in a single heat-treatment condition. Several different methods to achieve the different properties have been tried. In one method, the hub is made of one material composition and the rim is made of a different material composition joined to the hub material by an appropriate technique such as inertia welding or a co-extrusion process. The joint region may contain imperfections, arising both from the processing and from the local significant composition gradient, that limit the operating performance of the disk. In another method, the entire disk is made of one material, but the hub and rim are given different heat treatments. Precisely controlling the different heat treatments is difficult, and the properties of the hub and rim are still limited by the available properties of the selected material. In another method, the disk may be built up gradually using metal spray techniques in which the composition is slowly varied with radial position. It is difficult to control spray-produced imperfections and achieve high structural integrity with this approach. In another method, a higher performance, single-composition material is selected, but these higher performance materials are usually more costly.

The various methods all have limitations in the perfection of the metal or metals that form the disk or other part. Regardless of the technique used, the article has some fundamental limitations in that imperfections are always present that can lead to premature failure of the article. There is accordingly a need for an improved approach to making articles having property requirements that vary according to position within the article. The present invention fulfills this need, and further provides related advantages.

SUMMARY OF THE INVENTION

The present approach provides a method for making an article wherein the composition, and thence the properties, of the article vary with location within the article in a known, controllable manner. The properties, such as the mechanical or physical properties, may be varied widely, as with different alloys of a single base metal or alloys of different base metals, in a single article. The compositions are preferably graded so that there are no abrupt compositional transitions that result in irregularities at interfaces and severe thermal stresses and strains. No joining operations are needed. With the present approach, irregularities that are otherwise present in the article due to melting and casting are not present. These irregularities, such as ceramic inclusions, can lead to premature failure of conventional cast or cast-and-worked articles. The present approach also reduces the cost of the articles by reducing the processing steps and avoiding melt processing (i.e., cast-and-wrought processing and powder metallurgy processing where the metal is melted to create the powder) and the procedures that are often required to eliminate melt-related irregularities.

A method for preparing a metallic article made of metallic constituent elements includes the step of furnishing a mixture of nonmetallic precursor compounds of the metallic constituent elements. The precursor compounds may be of any operable type. Metallic-oxide precursor compounds are one preferred type of chemically reducible precursor. The mixture typically comprises more of a base metal than any other metallic element, with the base metal in the form of the chemically reducible precursor compound. The base metal is typically selected from the group consisting of titanium, aluminum, nickel, cobalt, iron, iron-nickel, and iron-nickel-cobalt, but the present approach is not so limited.

The method further includes chemically reducing the mixture of nonmetallic precursor compounds to produce an initial metallic material, without melting the initial metallic material. The chemical reduction may be accomplished by any operable approach, such as, for example, solid-phase reduction or vapor-phase reduction. The initial metallic material is consolidated to produce a consolidated metallic article, without melting the initial metallic material and without melting the consolidated metallic article. The consolidation is preferably performed without the presence of a binder, such as a fugitive organic binder.

A net macroscopic composition of the consolidated metallic article is intentionally varied spatially according to a pre-selected pattern, or, alternatively stated, intentionally varies in a pre-selected graded pattern. This intentional spatial variation is to be contrasted with situations where there is an unintentional spatial variation as a natural result of a processing approach. The spatial variation in the net macroscopic composition may be produced either by spatially varying the net macroscopic composition of the nonmetallic precursor compounds prior to the chemical reduction, or by first chemically reducing the nonmetallic precursor compounds and then spatially varying their net macroscopic composition, or by a combination of these two techniques. This flexibility in approach is particularly advantageous in the fabrication of articles having a graded composition. However, in some cases the availability of the techniques may be limited by the selected chemical reduction technique. For example, any of these techniques may be used in conjunction with solid-state reduction techniques, while the technique of varying the composition prior to the chemical reduction is typically not available in conjunction with vapor-phase reduction.

The nonmetallic precursor compounds may be furnished as uncompacted powders. In that case, the uncompacted precursor powders may be chemically reduced in the uncompacted form, or there may be an additional step, after the step of furnishing and prior to the step of chemically reducing, of compacting the uncompacted powders. Alternatively, the nonmetallic precursor compounds may be furnished as at least two compacts of precompacted powders. These precompacted compacts of the precursor compounds may then be contacted together and co-reduced. Yet other approaches use both one or more precompacts and uncompacted powders together, followed by a co-reduction.

A key feature of the present approach is that the metallic elements are not melted. As a result, irregularities associated with melting are avoided. Another important benefit is that alloys may be prepared of elements that are otherwise thermophysically incompatible. Thus, for example, the step of furnishing the mixture may include the step of providing a chemically reducible nonmetallic base-metal precursor compound of a base metal, and providing a chemically reducible nonmetallic alloying-element precursor compound of an alloying element, wherein the alloying element is thermophysically melt incompatible with the base metal. If an attempt were made to prepare an article of such alloying elements by the conventional melting-and-casting approach, the resulting cast structure would not be properly alloyed and would result in the formation of an undesirable microstructure.

The present approach may also be used to produce articles that contain dispersoids, which strengthen or otherwise modify the properties of the materials. The dispersoid is typically introduced into the mixture of precursor compounds, but it does not chemically reduce with the precursor compounds. The present approach may be used to introduce other additive constituents into the alloy. In either case, the dispersoid and/or another additive constituent may be added uniformly or in a non-uniform manner so that the effects of the addition are spatially varied in a controllable manner.

The present approach allows the use of various types of post-processing of the consolidated metallic article, such as forming, heat treating, machining, or coating the consolidated metallic article. These post-processing operations may be applied uniformly throughout the article, or may also be spatially varying.

In an application of current interest, the present approach is used to prepare a gas turbine engine disk starting shape, which is then post-processed to a final gas turbine engine disk. The net macroscopic composition is spatially nonuniform such that the properties of the gas turbine engine disk vary so as to produce optimal mechanical performance. The avoidance of melting ensures that melt-related irregularities, such as ceramic particles and inclusions, are not present in the final disk. Such melt-related irregularities often are the performance-limiting considerations in cast-and-wrought disks.

The present approach provides a technique for preparing articles that have a spatially varying composition, which is precisely controllable, and thence spatially varying properties that are precisely controllable. Melt-related irregularities are avoided by preparing the article from nonmetallic precursor compounds, reducing the precursor compounds to the metallic state, and consolidating and post-processing, without any melting of the metals during the processing. The cost of the articles prepared by the present approach is less than that produced by competing approaches.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
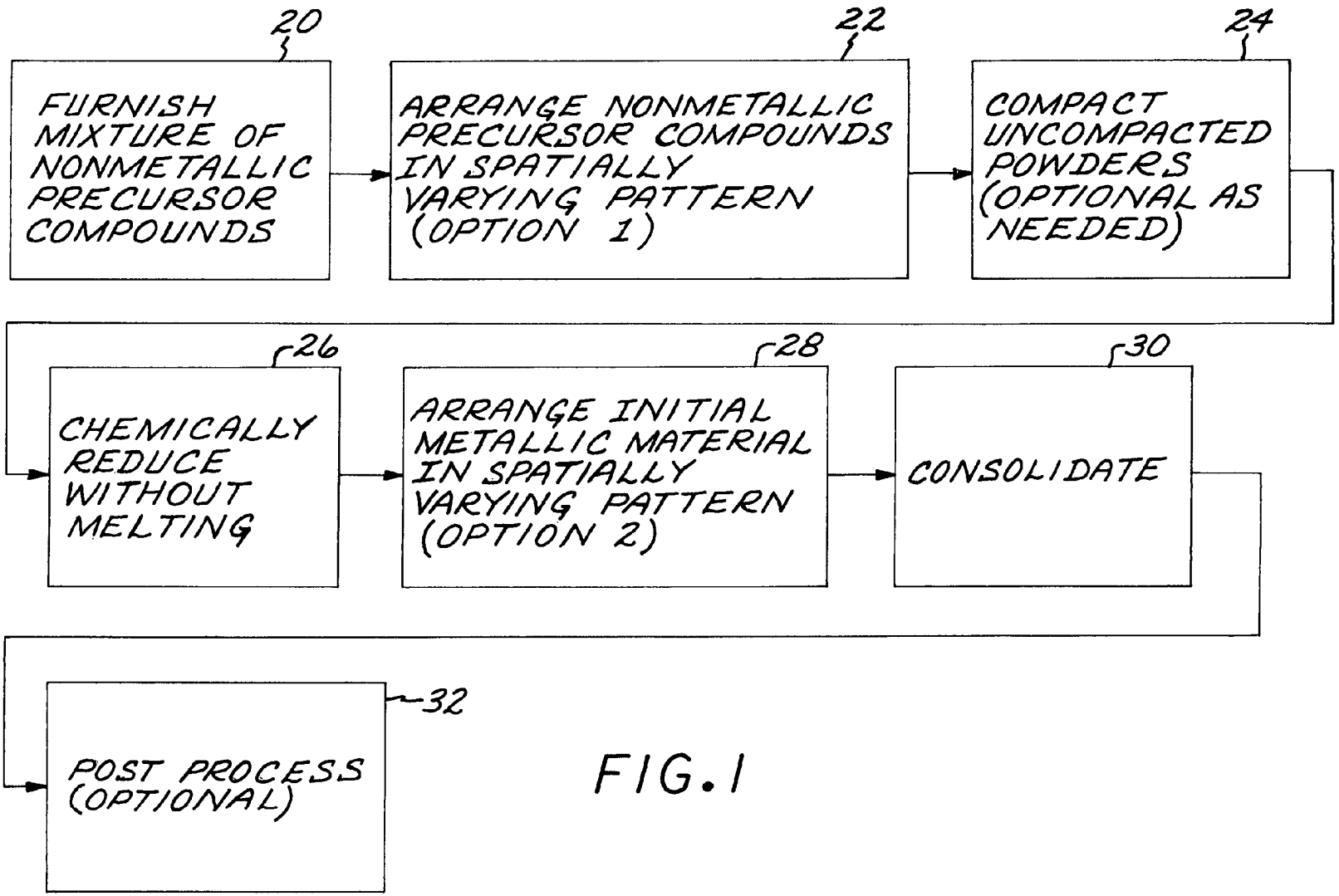
FIG. 1 is a block diagram of a preferred method for practicing an embodiment of the invention.
Figure 2:
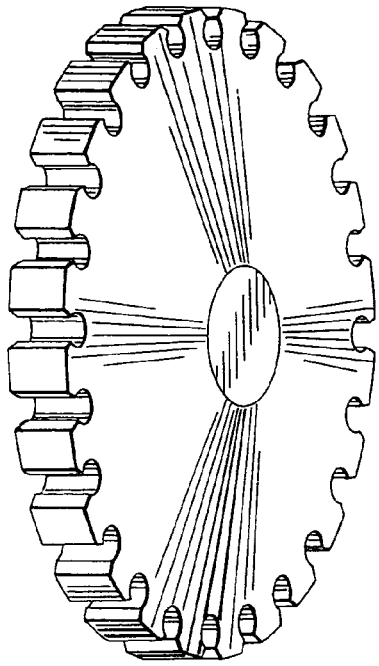
FIG. 2 is a perspective view of a gas turbine engine disk article.

FIG. 1 is a block flow diagram of a preferred approach for preparing a metallic article made of metallic constituent elements. FIG. 2 depicts an article 40 of interest, in this case a gas turbine engine disk made of a titanium alloy whose composition varies with position in the article 40. The properties of this article 40 desirably vary spatially in a controlled manner that may be pre-selected by the designer of the article 40. In the case of the gas turbine engine disk article 40, it may be preferred that the high tensile strength and fatigue strength at moderate temperatures are achieved near a hub 42 or center of the gas turbine engine disk article 40, and that high creep strength, crack-growth resistance, corrosion/oxidation resistance, and surface damage tolerance at higher temperatures are achieved near a rim 44 of the gas turbine engine disk article 40. This variation in properties is achieved in the present approach by controllably changing the composition of the material of construction of the article 40 as a function of location within the article 40. For the cylindrically symmetric gas turbine engine disk, the composition of the material of construction is varied as a function of a single variable, radius, but it could be varied in two or three dimensions.

The method includes furnishing a mixture of nonmetallic precursor compounds of the metallic constituent elements, step 20. The mixture of nonmetallic precursor compounds typically includes a chemically reducible nonmetallic base-metal precursor compound and a chemically reducible nonmetallic alloying-element precursor compound of an alloying element. "Nonmetallic precursor compounds" are nonmetallic compounds of the metals that eventually constitute the metallic article 40. Any operable nonmetallic precursor compounds may be used. Reducible oxides of the metals are the preferred nonmetallic precursor compounds in solid-phase reduction, but other types of nonmetallic compounds such as sulfides, carbides, halides, and nitrides are also operable. Reducible halides of the metals are the preferred nonmetallic precursor compounds in vapor-phase reduction.

The base metal may be any operable metal. For structural applications, the base metal is preferably selected from the group consisting of titanium, aluminum, nickel, cobalt, iron, iron-nickel, and iron-nickel-cobalt. That is, individual locations in the final article have more of the base metal than any other element or combination of elements. Because titanium-base alloys are of particular and preferred interest, they will be used to illustrate the principles of the present approach. The precursor compound that supplies the base metal is selected according to the base metal and the process to be used in the subsequently described chemical reduction. As an example, for titanium as the base metal and solid state reduction as the chemical reduction method, the precursor compound is preferably titanium dioxide; for titanium as the base metal and vapor phase reduction as the chemical reduction method, the precursor compound is preferably titanium tetrachloride. The alloying element may be any element that is available in the chemically reducible form of the precursor compound. For the case of titanium base metal, a few illustrative examples of alloying elements are cadmium, zinc, silver, iron, cobalt, chromium, bismuth, copper, tungsten, tantalum, molybdenum, aluminum, vanadium, niobium, nickel, manganese, magnesium, lithium, beryllium, and the rare earths. Mixtures of different types of precursor compounds may be used, as long as they are operable in the subsequent chemical reduction.

The nonmetallic precursor compounds are selected to provide the necessary metals in the final metallic article, and are mixed together in the proper proportions to yield the necessary proportions of these metals in the metallic article. For example, if a first location in the final article were to have particular proportions of titanium, aluminum, and vanadium in the ratio of 90:6:4 by weight, the nonmetallic precursor compounds are preferably titanium oxide, aluminum oxide, and vanadium oxide for solid-phase reduction, or titanium tetrachloride, aluminum chloride, and vanadium chloride for vapor-phase reduction. If another location in the final article were to have particular proportions of titanium, aluminum, vanadium, erbium, and oxygen in the ratio of 86.5:6:4:3:0.5 by weight, the nonmetallic precursor compounds are preferably titanium oxide, aluminum oxide, vanadium oxide, and erbium oxide for solid-phase reduction, or titanium tetrachloride, aluminum chloride, vanadium chloride, and erbium chloride for vapor-phase reduction. The final oxygen content is controlled by the reduction process, as subsequently discussed. Nonmetallic precursor compounds that serve as a source of more than one of the metals in the final metallic article may also be used. These precursor compounds are furnished and mixed together in the correct proportions such that the ratio of the elements in the mixture of precursor compounds is that required to form the metallic alloy.

The base-metal precursor compound and the alloying precursor compound are finely divided solids or gaseous in form to ensure that they are chemically reacted in the subsequent step. The finely divided solid base-metal compound and alloying compound may be, for example, powders, granules, flakes, or the like. The preferred maximum dimension of the finely divided solid form is about 100 micrometers, although it is preferred that the maximum dimension be less than about 10 micrometers to ensure good reactivity.

One of the advantages of the present approach is that it readily permits the introduction of alloying elements that would otherwise be difficult or impossible to introduce into alloys. One such type of alloy element is thermophysically melt incompatible alloying elements. "Thermophysical melt incompatibility" and related terms refer to the basic concept that any identified thermophysical property of an alloying element is sufficiently different from that of the base metal, in the preferred case titanium, to cause detrimental effects in the melted final product. These detrimental effects include phenomena such as chemical inhomogeneity (detrimental micro-segregation, macro-segregation such as beta flecks, and gross segregation from vaporization or immiscibility), inclusions of the alloying elements (such as high-density inclusions from elements such as tungsten, tantalum, molybdenum, and niobium), and the like. Thermophysical properties are intrinsic to the elements, and combinations of the elements, which form alloys, and are typically envisioned using equilibrium phase diagrams, vapor pressure versus temperature curves, curves of densities as a function of crystal structure and temperature, and similar approaches. Although alloy systems may only approach predicted equilibrium, these envisioning data provide information sufficient to recognize and predict the cause of the detrimental effects as thermophysical melt incompatibilities. However, the ability to recognize and predict these detrimental effects as a result of the thermophysical melt incompatibility does not eliminate them. The present approach provides a technique to minimize and desirably avoid the detrimental effects by the elimination of melting in the preparation and processing of the alloy.

Thus, "thermophysical melt incompatible" and related terms mean that the alloying element or elements in the alloy to be produced do not form a well mixed, homogeneous alloy with the base metal in a production melting operation in a stable, controllable fashion. In some instances, a thermophysically melt incompatible alloying element cannot be readily incorporated into the alloy at any compositional level, and in other instances the alloying element can be incorporated at low levels but not at higher levels. For example, iron does not behave in a thermophysically melt incompatible manner when introduced at low levels in titanium, typically up to about 0.3 weight percent, and homogeneous titanium-iron-containing alloys of low iron contents may be prepared. However, if iron is introduced at higher levels into titanium, it tends to segregate strongly in the melt and thus behaves in a thermophysically melt incompatible manner so that homogeneous alloys can only be prepared with great difficulty. In other examples, when magnesium is added to a titanium melt in vacuum, the magnesium immediately begins to vaporize due to its low vapor pressure, and therefore the melting cannot be accomplished in a stable manner. Tungsten tends to segregate in a titanium melt due to its density difference with titanium, making the formation of a homogeneous titanium-tungsten alloy extremely difficult.

The thermophysical melt incompatibility of the alloying element with titanium or other base metal may be any of several types, and some examples follow. The principles relating to thermophysical melt incompatibility are broadly applicable to a wide range of base-metal alloys. The principles will be illustrated with examples for the case of titanium-base alloys, the presently most preferred alloy system.

One such thermophysical melt incompatibility is in the vapor pressure, as where the alloying element has an evaporation rate of greater than about 10 times that of titanium at a melt temperature, which is preferably a temperature just above the liquidus temperature of the alloy. Examples of such alloying elements in titanium include cadmium, zinc, bismuth, magnesium, and silver. Where the vapor pressure of the alloying element is too high, it will preferentially evaporate, as indicated by the evaporation rate values, when co-melted with titanium under a vacuum in conventional melting practice. An alloy will be formed, but it is not stable during melting and continuously loses the alloying element so that the percentage of the alloying element in the final alloy is difficult to control. In the present approach, because there is no vacuum melting, the high melt vapor pressure of the alloying element is not a concern.

Another such thermophysical melt incompatibility occurs when the melting point of the alloying element is too high or too low to be compatible with that of titanium, as where the alloying element has a melting point that is greatly different from (either greater than or less than) that of the base metal. In the case of titanium, the melting point difference is more than about 400° C. (720° F.), although the required melting point difference may be larger or smaller for other base metals. Examples of such alloying elements in titanium include tungsten, tantalum, molybdenum, magnesium, and tin. If the melting point of the alloying element is too high, it is difficult to melt and homogenize the alloying element into the titanium melt in conventional vacuum melting practice. The segregation of such alloying elements may result in the formation of high-density inclusions containing that element, for example tungsten, tantalum, or molybdenum inclusions. If the melting point of the alloying element is too low, it will likely have an excessively high vapor pressure at the temperature required to melt the titanium. In the present approach, because there is no vacuum melting, the overly high or low melting points are not a concern.

Another such thermophysical melt incompatibility occurs when the density of the alloying element is so different from that of the base metal that the alloying element physically separates in the melt, as where the alloying element has a density difference with the base metal of greater than about 0.5 gram per cubic centimeter. Examples of such alloying elements in titanium include tungsten, tantalum, molybdenum, niobium, and aluminum. In conventional melting practice, the overly high or low density leads to gravity-driven segregation of the alloying element. In the present approach, because there is no melting there can be no gravity-driven segregation.

Another such thermophysical melt incompatibility occurs when the alloying element chemically reacts with the base metal in the liquid phase. Examples in titanium of such alloying elements include oxygen, nitrogen, silicon, boron, and beryllium. In conventional melting practice, the chemical reactivity of the alloying element with titanium leads to the formation of intermetallic compounds including titanium and the alloying element, and/or other deleterious phases in the melt, which are retained after the melt is solidified. These phases often have adverse effects on the properties of the final alloy. In the present approach, because the metals are not heated to the point where these reactions occur, the compounds are not formed.

Another such thermophysical melt incompatibility occurs when the alloying element exhibits a miscibility gap with the base metal in the liquid phase. Examples of such alloying elements in titanium include the rare earths such as cerium, gadolinium, lanthanum, and neodymium. In conventional melting practice, a miscibility gap leads to a segregation of the melt into the compositions defined by the miscibility gap. The result is inhomogeneities in the melt, which are retained in the final solidified article. The inhomogeneities lead to variations in properties throughout the final article. In the present approach, because the elements are not melted, the miscibility gap is not a concern.

Another, more complex thermophysical melt incompatibility involves reactions during solidification, which can result in undesirable phase distributions. In the case of titanium-base alloys, strong beta stabilizing elements exhibit large liquidus-to-solidus gaps when alloyed with the base metal. Some elements, such as iron, cobalt, and chromium, typically exhibit eutectic (or near-eutectic) phase reactions with titanium, and also usually exhibit a solid state-eutectoid decomposition of the beta phase into alpha phase plus a compound. Other elements, such as bismuth and copper, typically exhibit peritectic phase reactions with titanium yielding beta phase from the liquid, and likewise usually exhibit a solid state eutectoid decomposition of the beta phase into alpha phase plus a compound. Such elements present extreme difficulties in achieving alloy homogeneity during solidification from the melt. This results in micro-segregation, not only because of normal solidification partitioning but also because melt process perturbations cause separation of the beta-stabilizing-element-rich liquid during solidification to produce macro-segregation regions typically called beta flecks.

Another thermophysical melt incompatibility involves elements such as the alkali metals and alkali-earth metals that have very limited solubility in base-metal alloys. Examples in titanium base metal include lithium and calcium. Finely divided dispersions of these elements, for example beta calcium in alpha titanium, may not be readily achieved using a melt process.

Another thermophysical incompatibility is not strictly related to the nature of the base metal, but instead to the crucibles or environment in which the base metal is melted. Base metals may require the use of a particular crucible material or melting atmosphere, and some potential alloying elements may react with those crucible materials or melting atmospheres, and therefore not be candidates as alloying elements for that particular base metal.

These and other types of thermophysical melt incompatibilities lead to difficulty or impossibility in forming acceptable alloys of these elements in conventional production melting. Their adverse effects are avoided in the present melt-less approach. The thermophysically melt incompatible elements are introduced into the furnishing step 20 as nonmetallic precursor compounds, and processed through the remainder of the steps as described subsequently.

The present approach also allows dispersoids to be included in the article, either in a uniform or a non-uniform distribution. Examples of suitable dispersoids include, for example, oxides, carbides, nitrides, borides, or sulfides, formed with the elements of the metallic matrix or with other intentionally added elements. The dispersoids may be simple chemical forms. The dispersoids may instead be more complex, multicomponent compounds such as, for example, carbonitrides or multicomponent oxides such as $Y_2O_3$—$Al_2O_3$-based oxides. Such dispersoids for titanium alloys usually include an element (or elements) selected from the group consisting of oxygen, carbon, nitrogen, boron, sulfur, and combinations thereof, and also can be formed of or include intermetallic compounds. The dispersoids are either thermodynamically stable (non-reducible) compared to the matrix alloy, or too chemically inert to be reduced by the process that reduces the matrix precursor compounds. The dispersoid is introduced at a point in the processing where it is stable with respect to all subsequent processing steps. That is, if a particular type of dispersoid is unstable with respect to some earlier processing step, it is introduced only after that processing step is completed. The dispersoids may be present in any amount. However, the dispersoid is preferably present in an amount sufficient to provide increased strength to the article 40 by inhibiting dislocation movement in the metallic matrix, by acting as a composite-material strengthener, and/or by inhibiting movement of the grain boundaries. The volume fraction of dispersoids required to perform these functions varies depending upon the nature of the matrix and the dispersoid, but is typically at least about 0.5 percent by volume of the article, and more preferably at least about 1.5 percent by volume of the article. To achieve these volume fractions, the elements that react to form the dispersoid must be present in a sufficient amount.

The dispersoids may be introduced in their final form, as just discussed. They may instead be formed by a chemical reaction during the processing. For example, a stable-oxide-forming additive element is characterized by the formation of a stable oxide in a titanium-based alloy. An element is considered to be a stable-oxide-forming additive element if it forms a stable oxide in a titanium-base alloy (in the example of interest), where the titanium-base alloy either has substantially no oxygen in solid solution or where the titanium-base alloy has a small amount of oxygen in solid solution. As much as about 0.25 weight percent oxygen in solid solution may be required for the stable-oxide-forming additive element to function as an effective stable-oxide former. Thus, preferably, the titanium-base alloy has from zero to about 0.25 weight percent oxygen in solid solution. Larger amounts of oxygen may be present, but such larger amounts may have an adverse effect on ductility. In general, oxygen may be present in a material either in solid solution or as a discrete oxide phase such as the oxides formed by the stable-oxide-forming additive elements when they react with oxygen.

Titanium has a strong affinity for and is highly reactive with oxygen, so that it dissolves many oxides, including its own. The stable-oxide-forming additive elements within the scope of the present approach form a stable oxide that is not dissolved by the titanium alloy matrix. Examples of stable-oxide-forming additive elements are strong oxide-formers such as magnesium, calcium, scandium, and yttrium, and rare earths such as lanthanum, cerium, praseodymium, neodymium, promethium, samarium, europium, gadolinium, terbium, dysprosium, holmium, erbium, thulium, ytterbium, and lutetium, and mixtures thereof.

At least one additive element is present at a level greater than its room-temperature solid solubility limit in the titanium-base alloy. After subsequent processing, each such additive element is partitioned into one of several forms. The additive element may be present as a non-oxide dispersion of the element. It may also be present in solid solution. It may also be present in a form that is reacted with oxygen to form a coarse oxide dispersion or a fine oxide dispersion. The coarse oxide dispersion forms by the reaction of the non-oxide dispersion of the element with oxygen that is typically present in the metallic matrix, thereby gettering the oxygen. The fine oxide dispersion forms by the reaction of the stable-oxide-forming additive element that is in solid solution, with oxygen that is in the matrix or diffuses into the metallic material from the surface during exposure to an oxygen-containing environment.

FIG. 1 illustrates two approaches (indicated in steps 22 and 28) by which the spatial variation in composition may be achieved. In the first approach, step 22 and indicated as Option 1, the nonmetallic precursor compounds are arranged to achieve the spatially non-uniform net macroscopic composition, prior to chemical reduction. In one implementation of step 22, the nonmetallic precursor compounds placed into a form that defines the general shape of a starting shape of the final article 40. For the illustrated gas turbine engine disk article 40, the form preferably has the general disk-like shape, without any dovetail notches 46. The form is typically larger in size than the required size of the final article 40, to account for subsequent compacting and consolidation. In another implementation, the nonmetallic precursor compounds are placed into a general shape form, consolidated, and processed to shape, as for example by extrusion or forging.

Figure 3:
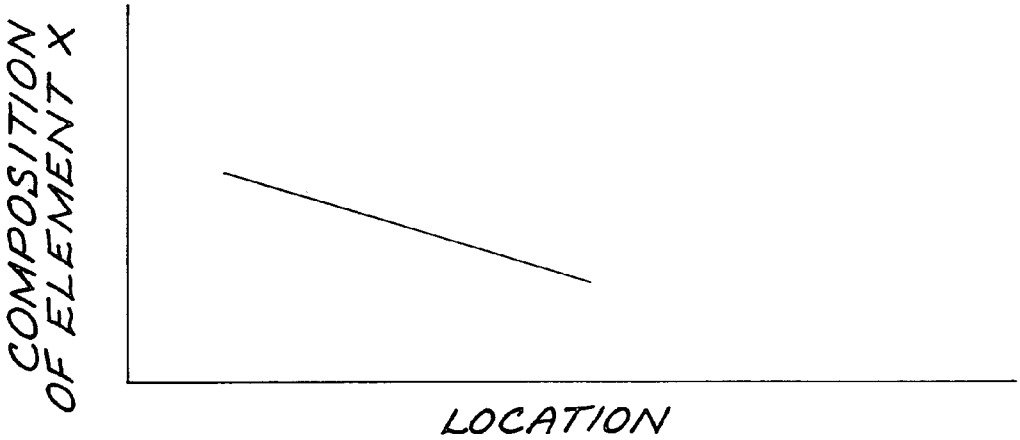
FIG. 3 is a schematic graph of a first form of a net macroscopic composition as a function of position in an article.
Figure 4:
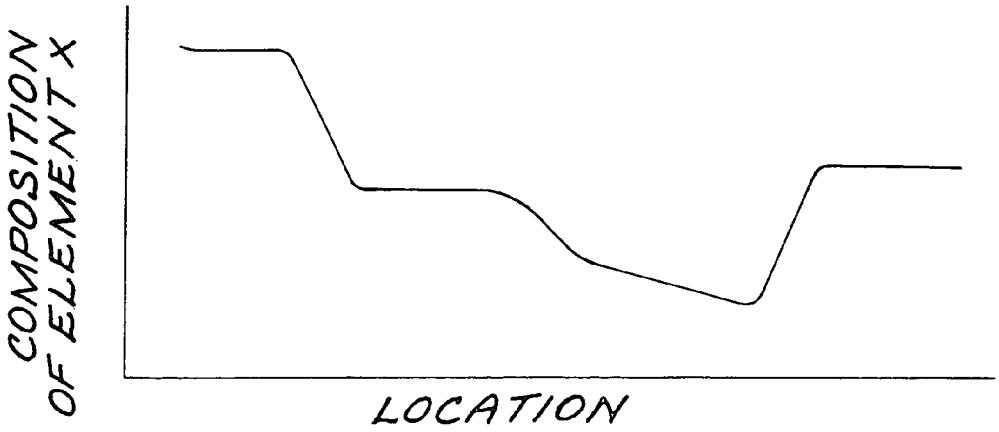
FIG. 4 is a schematic graph of a second form of a net macroscopic composition as a function of position in an article.

The net macroscopic composition of the mixture is intentionally varied spatially according to a preselected pattern, which is also termed a "graded" compositional profile. The spatial extent of the variation is typically at least one inch or more, because smaller spatial variations are difficult to attain by the present approach unless special care is taken. The preselected pattern varies according to the nature of the article 40 and the specific property requirements. The preselected pattern is therefore typically provided as an external input to the present method, and the method provides the means by which the preselected pattern may be achieved. FIGS. 3 and 4 provide two illustrative examples of preselected patterns of composition profiles, in this case radial profiles of the composition in the gas turbine engine disk article 40 of FIG. 2. The graded composition profile in FIG. 3 is a simply varying composition change, while that in FIG. 4 is more complex. The composition is the net macroscopic composition of the mixture, expressed for an arbitrary element "X". A virtue of the present approach is that the net macroscopic compositions may vary in different ways for different elements X. The "net macroscopic composition" refers to a composition that is measured on a scale that is large compared to the dimensions of individual particles of the nonmetallic precursor compounds, so that it reflects an average value in a local volume of the mixture.

In the first-mentioned implementation of step 22, the nonmetallic precursor compounds are placed into a form or mold that defines the desired shape at this stage. The placement is performed to achieve the preselected pattern of composition of the final article. The manner of the placement is dependent upon the form in which the precursor compounds are provided. The nonmetallic precursor compounds may be provided as uncompacted powders, and are placed into the form to achieve the preselected pattern of composition. For example, if the composition is to vary linearly as in FIG. 3, the amounts of the various precursor powders may be varied linearly in a comparable manner. Alternatively, the nonmetallic precursor compounds may be furnished as uncompacted powders and then compacted, optional step 24, after the step of furnishing 20 and the step of arranging 22, and prior to the subsequent step of chemically reducing. In compacting the powders, the powders are arranged in a form as required by the preselected composition distribution. The entire compact may then define the article precursor. Instead, the nonmetallic precursor compounds comprise at least two compacts of precompacted powders. At least one of the compacts may have a net macroscopic composition of the compact that varies spatially, or both may have a constant composition throughout. The loose-powder and precompact approaches may be used together, so that a portion of the powder mass is precompacted and a portion is not precompacted.

The mixture of nonmetallic precursor compounds is chemically reduced to produce an initial metallic material, without melting the initial metallic material, step 26. As used herein, "without melting", "no melting", and related concepts mean that the material is not macroscopically or grossly melted, so that it liquefies and loses its shape. There may be, for example, some minor amount of localized melting as low-melting-point elements melt and are diffusionally alloyed with the higher-melting-point elements that do not melt. Even in such cases, the gross shape of the material remains unchanged.

In one approach, termed solid-phase reduction because the nonmetallic precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic precursor compounds is immersed in an electrolysis cell in a fused salt electrolyte such as a chloride salt at a temperature below the melting temperature of the alloy that forms from the nonmetallic precursor compounds. The mixture of nonmetallic precursor compounds is made the cathode of the electrolysis cell, with an inert or other anode. The elements combined with the metals in the nonmetallic precursor compounds, such as oxygen in the preferred case of oxide nonmetallic precursor compounds, are removed from the mixture by chemical reduction (i.e., the reverse of chemical oxidation). The reaction is performed at an elevated temperature. The cathodic potential is controlled to ensure that the reduction of the nonmetallic precursor compounds will occur. The electrolyte is a salt, preferably a salt that is more stable than the equivalent salt of the metals being refined and ideally very stable to remove the oxygen or other gas to a low level. The chlorides and mixtures of chlorides of barium, calcium, cesium, lithium, strontium, and yttrium are preferred as the molten salt. The chemical reduction may be carried to completion, so that the nonmetallic precursor compounds are completely reduced. The chemical reduction may instead be performed only partially, in the case of oxide precursors to control the oxygen content.

In another approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. In one embodiment, a mixture of appropriate gases in the appropriate amounts is contacted to molten sodium, so that the metallic halides are reduced to the metallic form. The metallic alloy is separated from the sodium. This reduction is performed at temperatures below the melting point of the metallic alloy, so that the metallic alloy is not melted. The approach is described more fully in U.S. Pat. Nos. 5,779,761 and 5,958,106, whose disclosures are incorporated by reference in their entireties.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, a carbon-containing gas may be mixed with the gaseous nonmetallic precursor compound(s) to increase the level of carbon in the metallic alloy. Similarly, elements such as sulfur, nitrogen, and boron may be added using appropriate gaseous compounds of these elements. Complex combinations of such gaseous elements may be provided and mixed together, such as gaseous compounds of nitrogen, sulfur, carbon, phosphorus, and/or boron, leading to precursor compound phase dissolution of such additive elements or to the formation of chemically more-complex second phases.

The physical form of the metallic material at the completion of step 26 depends upon the physical form of the mixture of nonmetallic precursor compounds at the beginning of step 26. If the mixture of nonmetallic precursor compounds is free-flowing, finely divided particles, powders, granules, pieces, or the like, the metallic material is also in the same form, except that it is smaller in size and typically somewhat porous. If the mixture of nonmetallic precursor compounds is a compressed mass of the finely divided particles, powders, granules, pieces, or the like, then the final physical form of the metallic material is typically in the form of a somewhat porous metallic sponge. The external dimensions of the metallic sponge are smaller than those of the compressed mass of the nonmetallic precursor compound due to the removal of the oxygen and/or other combined elements in the reduction step 26. If the mixture of nonmetallic precursor compounds is a vapor, then the final physical form of the metallic material is typically fine powder that may be further processed.

Some constituents, termed "other additive constituents", may be difficult to introduce. For example, suitable nonmetallic precursor compounds of the constituents may not be available, or the available nonmetallic precursor compounds of the other additive constituents may not be readily chemically reducible in a manner or at a temperature consistent with the chemical reduction of other nonmetallic precursor compounds. It may be necessary that such other additive constituents ultimately be present as elements in solid solution in the article, as compounds formed by reaction with other constituents of the article, or as already-reacted, substantially inert compounds dispersed through the article. These other additive constituents or precursors thereof may be introduced from the gas, liquid, or solid phase, as may be appropriate, using one of the four approaches subsequently described or other operable approaches.

In a first approach, the other additive constituents are furnished as elements or compounds and are mixed with the precursor compounds prior to or concurrently with the step of chemically reducing. The mixture of precursor compounds and other additive constituents is subjected to the chemical reduction treatment of step 24, but only the precursor compounds are actually reduced and the other additive constituents are not reduced.

In a second approach, the other additive constituents in the form of solid particles are furnished but are not subjected to the chemical reduction treatment. Instead, they are mixed with the initial metallic material that results from the chemical reduction step, but after the step of chemically reducing 24 is complete. This approach is particularly effective when the step of chemically reducing is performed on a flowing powder of the precursor compounds, but it also may be performed on a pre-compacted mass of the precursor compounds, resulting in a spongy mass of the initial metallic material. The other additive constituents are adhered to the surface of the powder or to the surface of, and into the porosity of, the spongy mass.

In a third approach, the precursor is first produced as powder particles, or as a sponge by compacting the precursor compounds of the metallic elements. The particles are, or the sponge is, then chemically reduced. The other additive constituent is thereafter produced at the surfaces (external and internal, if the particles are sponge-like) of the particles, or at the external and internal surfaces of the sponge, from the gaseous phase. In one technique, a gaseous precursor or elemental form (e.g., methane or nitrogen gas) is flowed over the surface of the particle or the sponge to deposit the element onto the surface from the gas.

A fourth approach is similar to the third approach, except that the other additive constituent is deposited from a liquid rather than from a gas. The precursor is first produced as powder particles, or as a sponge by compacting the precursor compounds of the metallic elements. The particles are, or the sponge is, then chemically reduced. The other additive constituent is thereafter produced at the surfaces (external and internal, if the particles are sponge-like) of the particles, or at the external and internal surfaces of the sponge, by deposition from the liquid. In one technique, the particulate or sponge is dipped into a liquid solution of a precursor compound of the other additive constituent to coat the surfaces of the particles or the sponge. The precursor compound of the other additive constituent is second chemically reacted to leave the other additive constituent at the surfaces of the particles or at the surfaces of the sponge. In an example, lanthanum may be introduced into the material by coating the surfaces of the reduced particles or sponge (produced from the precursor compounds) with lanthanum chloride. The coated particles are, or the sponge is, thereafter heated and/or exposed to vacuum to drive off the chlorine, leaving lanthanum at the surfaces of the particles or sponge.

Whatever the reduction technique used in step 26 and however the other additive constituent is introduced, the result is a mixture that comprises the material composition. The metallic material may be free-flowing particles in some circumstances, or have a sponge-like structure in other cases. The sponge-like structure is produced in the solid-phase reduction approach if the precursor compounds have first been compacted together prior to the commencement of the actual chemical reduction. The precursor compounds may be compressed to form a compressed mass that is larger in dimensions than a desired final metallic article.

The second approach to achieving the spatially variation in composition is to arrange the already-reduced initial metallic material in a spatially varying pattern, step 28 and Option 2. This approach is similar to that of step 22, except that the reduced initial metallic material is produced in a spatially uniform form, and then the reduced initial metallic material is arranged in the spatially varying pattern. The approaches of step 28 are otherwise similar to those of step 22, and the prior discussion of step 22 is incorporated here, except as modified to relate to the initial metallic material.

Where step 22 is used, it is typically not necessary to perform step 28 on the same initial metallic compounds that are arranged in step 22. Where step 28 is used, it is typically not necessary to perform step 22 on the same initial metallic compounds that are arranged in step 28. However, in some applications both steps 22 and 28 are used. For example, step 22 may be employed as to some of the constituents in the final consolidated metallic article, and step 28 may be employed as to others of the constituents in the final consolidated metallic article. In such a case, the metallic precursor compounds may be arranged in a spatially varying pattern as in step 22, and then reduced metallic compounds may be added to this spatially varying pattern in step 28.

At this stage and whether steps 22 or 28 are used, the initial metallic material is typically in a form that is not structurally useful for most applications. Accordingly, the initial metallic material is thereafter consolidated to produce a consolidated metallic article, without melting the initial metallic article and without melting the consolidated metallic article, step 30. The consolidation removes porosity from the metallic article, desirably increasing its relative density to or near 100 percent. Any operable type of consolidation may be used. Preferably, the consolidation 30 is performed by hot isostatic pressing under appropriate conditions of temperature and pressure, but at a temperature less than the melting points of the initial metallic article and the consolidated metallic article (which melting points are typically the same or very close together). Pressing and solid-state sintering or extrusion of a canned material may also be used, particularly where the initial metallic article is in the form of a powder. The consolidation reduces the external dimensions of the initial metallic article, but such reduction in dimensions is predictable with experience for particular compositions. The consolidation processing 30 may also be used to achieve further alloying of the metallic article with alloying elements such as nitrogen and carbon. Most preferably, the consolidation is performed without the use of a binder, such as a fugitive organic binder, of the type that is often used in conventional powder metallurgy processing. The binder is termed a "fugitive" binder because it vaporizes during subsequent heating to sinter the powders. Such binders, while being largely removed during subsequent processing, may leave a residue of organic material in the final metallic article. In other cases, however, such a binder may be used.

The consolidated metallic article may be used in its as-consolidated form. Instead, in appropriate cases the consolidated metallic article may optionally be post processed, step 32. The post processing may include forming by any operable metallic forming process, as by forging, extrusion, rolling, and the like. Some metallic compositions are amenable to such forming operations, and others are not. The consolidated metallic article prepared by the present approach will be much more amenable to forming operations than its equivalent conventionally prepared (i.e., cast or cast-and-wrought) composition due to its finer grain size and potential for superplastic forming. The consolidated metallic article may also or instead be optionally post-processed by other conventional metal processing techniques in step 32. Such post-processing may include, for example, heat treating, surface coating, machining, and the like. The post-processing 32, when performed, may include one or more of such individual post-processing operations.

The initial metallic article and the consolidated metallic article are never heated above the melting point. Additionally, the articles may be maintained below specific temperatures that are themselves below the melting point, such as various precipitate (e.g., non-metallic particles such as carbides, or intermetallic particles) solvus temperatures. Such temperatures are known in the art for the specific compositions.

The microstructural type, morphology, and scale of the article is determined by the starting materials and the processing. The grains of the articles produced by the present approach generally correspond to the morphology and size of the powder particles of the starting materials, when the solid-phase reduction technique is used. In the present approach, the metal is never melted and cooled from the melt, so that the coarse grain structure associated with the solidified structure never occurs. In conventional melt-based practice, subsequent metalworking processes are designed to break up and reduce the coarse grain structure associated with solidification. Such processing is not required in the present approach.

The present approach processes the mixture of nonmetallic precursor compounds to a finished metallic form without the metal of the finished metallic form ever being heated above its melting point. Consequently, the process avoids the costs associated with melting operations,. such as controlled-atmosphere or vacuum furnace costs. The microstructures associated with melting, typically large-grained structures, casting irregularities, and segregation-related irregularities (e.g., freckles, white spots, and eutectic nodules in nickel-based alloys), are not found. Without such irregularities, the reliability or the articles is improved. The greater confidence in the irregularity-free state of the article, achieved with the better inspectability discussed above, also leads to a reduction in the extra material that must otherwise be present. Mechanical properties such as static strength, fatigue strength, and toughness may be improved, potentially allowing the articles to be lighter in weight. Inspectability is improved, and the product has reduced cost, irregularities, and porosity, as compared with the product of other powder metallurgy processing.

The spatial variation in composition results in a spatial variation in properties of the final consolidated metallic article. This spatial variation is chosen according to the particular article being prepared and its requirements for optimal properties.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing a metallic article made of metallic constituent elements, comprising the steps of furnishing a mixture of nonmetallic precursor compounds of the metallic constituent elements;

chemically reducing the mixture of nonmetallic precursor compounds to produce an initial metallic material, without melting the initial metallic material; and consolidating the initial metallic material to produce a consolidated metallic article, without melting the initial metallic material and without melting the consolidated metallic article, wherein a net macroscopic composition in the metallic matrix of the consolidated metallic article varies spatially according to a preselected pattern.

2. The method of claim 1, wherein the step of furnishing the mixture includes the step of furnishing the nonmetallic precursor compounds as uncompacted powders.

3. The method of claim 1, wherein the step of furnishing the mixture includes the step of furnishing the nonmetallic precursor compounds as uncompacted powders, and wherein the method includes an additional step, after the step of furnishing and prior to the step of chemically reducing, of compacting the uncompacted powders.

4. The method of claim 1, wherein the step of furnishing the mixture includes the step of furnishing the nonmetallic precursor compounds as at least two compacts of precompacted powders, wherein at least one of the compacts has a net macroscopic composition of the compact that varies spatially.

5. The method of claim 1, wherein the step of furnishing the mixture includes the step of furnishing the mixture comprising metallic-oxide precursor compounds.

6. The method of claim 1, wherein the step of furnishing the mixture includes the step of furnishing the mixture comprising more base metal than any other metallic element, wherein the base metal is selected from the group consisting of titanium, aluminum, nickel, and cobalt.

7. The method of claim 1, wherein the step of furnishing the mixture includes the step of furnishing the mixture comprising more base metal than any other metallic element, wherein the base metal is selected from the group consisting of iron, iron-nickel, and iron-nickel-cobalt.

8. The method of claim 1, wherein the step of furnishing the mixture includes the step of providing a chemically reducible nonmetallic base-metal precursor compound of a base metal, and providing a chemically reducible nonmetallic alloying-element precursor compound of an alloying element, wherein the alloying element is thermophysically melt incompatible with the base metal.

9. The method of claim 1, wherein the step of furnishing the mixture includes the step of furnishing the mixture having a dispersoid therein, wherein the dispersoid does not reduce in the step of chemically reducing.

10. The method of claim 1, further including a step, after the step of furnishing and before the step of chemically reducing, of arranging the nonmetallic precursor compounds in a spatially varying pattern.

11. The method of claim 1, wherein the step of chemically reducing includes the step of chemically reducing the mixture of nonmetallic precursor compounds by solid-phase reduction.

12. The method of claim 1, wherein the step of chemically reducing includes the step of chemically reducing the compound mixture by vapor-phase reduction.

13. The method of claim 1, wherein the step of consolidating includes the step of consolidating the initial metallic material without the use of a binder.

14. The method of claim 1, further including a step, after the step of chemically reducing and before the step of consolidating, of arranging the initial metallic material in a spatially varying pattern.

15. The method of claim 1, wherein the method includes the step of preparing the consolidated metallic article comprising a gas turbine engine disk starting shape.

16. The method of claim 1, including an additional step, prior to the step of consolidating, of producing a mixture of a metallic material and an other additive constituent.

17. The method of claim 1, including an additional step, after the step of consolidating, of forming the consolidated metallic article.

18. The method of claim 1, including an additional step, after the step of consolidating, of heat treating the consolidated metallic article.

19. A method for preparing a metallic article made of metallic constituent elements, comprising the steps of furnishing a mixture of nonmetallic precursor compounds of the metallic constituent elements;

chemically reducing the mixture of nonmetallic precursor compounds to produce an initial metallic material, without melting the initial metallic material, wherein the initial metallic material has more titanium or aluminum or nickel or cobalt or iron or iron-nickel or iron-nickel-cobalt than another other element; and consolidating the initial metallic material to produce a consolidated metallic article in the form of a gas turbine engine disk starting shape, without melting the initial metallic material and without melting the consolidated metallic article, wherein a net macroscopic composition in the metallic matrix of the consolidated metallic article varies spatially according to a preselected pattern.

20. The method of claim 19, wherein the step of furnishing the mixture includes the step of furnishing the nonmetallic precursor compounds as uncompacted powders.

21. The method of claim 19, wherein the step of furnishing the mixture includes the step of furnishing the nonmetallic precursor compounds as uncompacted powders, and wherein the method includes an additional step, after the step of furnishing and prior to the step of chemically reducing, of compacting the uncompacted powders.

22. The method of claim 19, wherein the step of furnishing the mixture includes the step of furnishing the nonmetallic precursor compounds as at least two compacts of precompacted powders, wherein at least one of the compacts has a net macroscopic composition of the compact that varies spatially.

23. The method of claim 19, wherein the step of furnishing the mixture includes the step of providing a chemically reducible nonmetallic base-metal precursor compound of a base metal, and providing a chemically reducible nonmetallic alloying-element precursor compound of an alloying element, wherein the alloying element is thermophysically melt incompatible with the base metal.

24. The method of claim 19, wherein the step of furnishing the mixture includes the step of furnishing the mixture having a dispersoid therein, wherein the dispersoid does not reduce in the step of chemically reducing.

25. The method of claim 19, further including a step, after the step of furnishing and before the step of chemically reducing, of arranging the nonmetallic precursor compounds in a spatially varying pattern.

26. The method of claim 19, further including a step, after the step of chemically reducing and before the step of consolidating, of arranging the initial metallic material in a spatially varying pattern.

27. The method of claim 19, including an additional step, after the step of consolidating, of forming the consolidated metallic article.

28. The method of claim 19, including an additional step, after the step of consolidating, of heat treating the consolidated metallic article.

29. The method of claim 19, wherein the step of consolidating includes the step of consolidating the initial metallic material without the use of a binder.

* * * * *